US006647346B1

(12) United States Patent
Zikes

(10) Patent No.: US 6,647,346 B1
(45) Date of Patent: Nov. 11, 2003

(54) COMPRESSOR CONTROL SYSTEM AND METHOD THEREFOR

(75) Inventor: Bradley C. Zikes, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/684,034

(22) Filed: Oct. 6, 2000

(51) Int. Cl.[7] ..... G01R 19/00

(52) U.S. Cl. ..... 702/65; 702/47; 702/57; 702/64; 702/184

(58) Field of Search ..... 62/126–127, 80; 307/112, 113, 130; 318/751, 756, 786, 781; 702/57, 47, 50, 64, 98, 113, 114, 115, 138, 140, 184, 188, 65, FOR 103, FOR 104, FOR 106, FOR 123, FOR 124, FOR 127, FOR 128, FOR 134, FOR 143, FOR 170, FOR 171

(56) References Cited

U.S. PATENT DOCUMENTS 3,777,187 A * 12/1973 Kohn ..... 307/310
4,045,973 A * 9/1977 Anderson et al. ..... 6/158
4,461,615 A 7/1984 Inoue ..... 431/76
4,605,863 A 8/1986 Toudo et al. ..... 307/269
RE32,360 E * 2/1987 Martineau ..... 62/127
4,653,285 A * 3/1987 Pohl ..... 62/126
4,722,018 A * 1/1988 Pohl ..... 361/22
4,866,363 A 9/1989 Patton et al. ..... 318/663
4,923,117 A 5/1990 Adams et al. ..... 236/94
4,925,386 A 5/1990 Donnelly et al. ..... 431/28
4,934,925 A 6/1990 Berlincourt ..... 431/67
5,515,297 A 5/1996 Bunting ..... 364/551.01
5,612,904 A 3/1997 Bunting ..... 364/551.01
5,808,441 A * 9/1998 Nehring ..... 318/751

* cited by examiner

*Primary Examiner*—Marc S. Hoff
*Assistant Examiner*—Felix Suarez
(74) *Attorney, Agent, or Firm*—Harness Dickey & Pierce, PLC

(57) ABSTRACT

A control system and method for controlling operation of a compressor in a device is disclosed. The system includes a line voltage measurement circuit which measures the difference in voltage between a first line voltage and a second line voltage being applied to the device, and a controller having means for storing a first and second threshold voltage, a comparator having an output for comparing the voltage difference to the first and second threshold voltages, and compressor control means for controlling operation of the compressor based on the output of the comparator.

27 Claims, 2 Drawing Sheets

COMPRESSOR CONTROL SYSTEM AND METHOD THEREFOR

BACKGROUND OF THE INVENTION

This invention relates to a control system for controlling the operation of a compressor in an appliance.

In HVAC systems, the compressor control mechanisms are typically operated off of the 24 Volt secondary winding of a transformer. Compressors need a high line voltage to operate properly. However, line voltages are susceptible to fluctuations, and in particular, going low as a result of poor connections, power failures and peak cooling demand times. A low line voltage causes the compressor to draw more current than necessary, causing it to overheat and burn out. Current compressor configurations do not allow the compressor control mechanisms to monitor the line voltage directly. As a result, there is no means to de-energize the compressor when line voltages get too low in order to prevent the compressor from overheating and burning out. Given the possibility of low line voltage occurrences, the cost for replacing compressors can become significant. Further, a malfunctioning compressor can render the HVAC system inoperable, further, increasing the cost of repair and/or replacement.

Accordingly, there is a need for a compressor control that prevents malfunctioning of the compressor due to fluctuations in line voltage.

SUMMARY OF THE INVENTION

A control system for controlling operation of a compressor in a device powered by a first and second line voltage is disclosed. The system comprises a line voltage measurement circuit for measuring a difference in voltage between the first line voltage and the second line voltage before and during the energizing of the compressor, and a controller in communication with the line voltage measurement circuit and the compressor, the controller comprising storage for storing at least a first threshold voltage, a comparator having an output for comparing the voltage difference to the first threshold voltage, and a compressor control mechanism for controlling operation of the compressor based on the output of the comparator. The compressor control comprises a switch for switching the compressor off when the voltage difference is less than the first threshold voltage for a predetermined period of time. The controller storage mechanism also stores a second threshold voltage, and the compressor control mechanism comprises another switch for switching the compressor off when the voltage difference goes below the second threshold voltage. The controller comprises a counter having a count representing a period of time, the count being initialized when the voltage difference is less than the first threshold voltage and incremented for as long as the output of the comparator shows the voltage difference less than the first threshold voltage. The compressor is switched off by the switch of the controller when the period of time equals the predetermined period of time.

The controller also may comprise an indicator for indicating when the compressor is turned off. In another embodiment, a control system comprises a line voltage measurement circuit for measuring a difference in voltage between the first line voltage and the second line voltage before and during the energizing of the compressor, and a controller in communication with the line voltage measurement circuit and the compressor. The controller comprises storage for storing a second threshold voltage, a comparator having an output for comparing the voltage difference to the second threshold voltage, and a compressor control mechanism for controlling operation of the compressor based on the output of the comparator. The compressor control mechanism comprises a switch for switching the compressor off when the voltage difference goes below the second threshold voltage. The controller may further comprise an indicator for indicating when the compressor is turned off.

A method for controlling operation of a compressor in a device powered by a first and second line voltage and having a controller is also disclosed. The method comprises measuring a difference in voltage between the first line voltage and the second line voltage before and during the energizing of the compressor, storing at least a first threshold voltage in the controller, comparing the voltage difference to the first threshold voltage, and controlling operation of the compressor based on the comparison between the voltage difference and the first threshold voltage. The method further comprises counting the period of time during which the voltage difference is less than the first threshold voltage and switching the compressor off when the period of time exceeds a predetermined period of time. The method may also further comprise storing a second threshold voltage in the controller and switching the compressor off when the voltage difference goes below the second threshold voltage. The method further comprises indicating to an operator of the device when the compressor is turned off.

In another embodiment, a method comprises measuring a difference in voltage between the first line voltage and the second line voltage before and during the energizing of the compressor, storing a second threshold voltage in the controller, and controlling operation of the compressor based on the comparison between the voltage difference and the second threshold voltage. The method further comprises switching the compressor off when the voltage difference goes below the second threshold voltage. The method may further comprise indicating to an operator of the device when the compressor is turned off.

While the principal advantages and features of the present invention have been explained above, a more complete understanding of the invention may be attained by referring to the description of the preferred embodiments.

DETAILED DESCRIPTION OF THE PREFERRED EMBODIMENT

While the invention will be described with respect to HVAC systems, it can be appreciated that it is applicable with respect to other systems using compressors, such as those using combustion motors or circulator motors.

Figure 1:
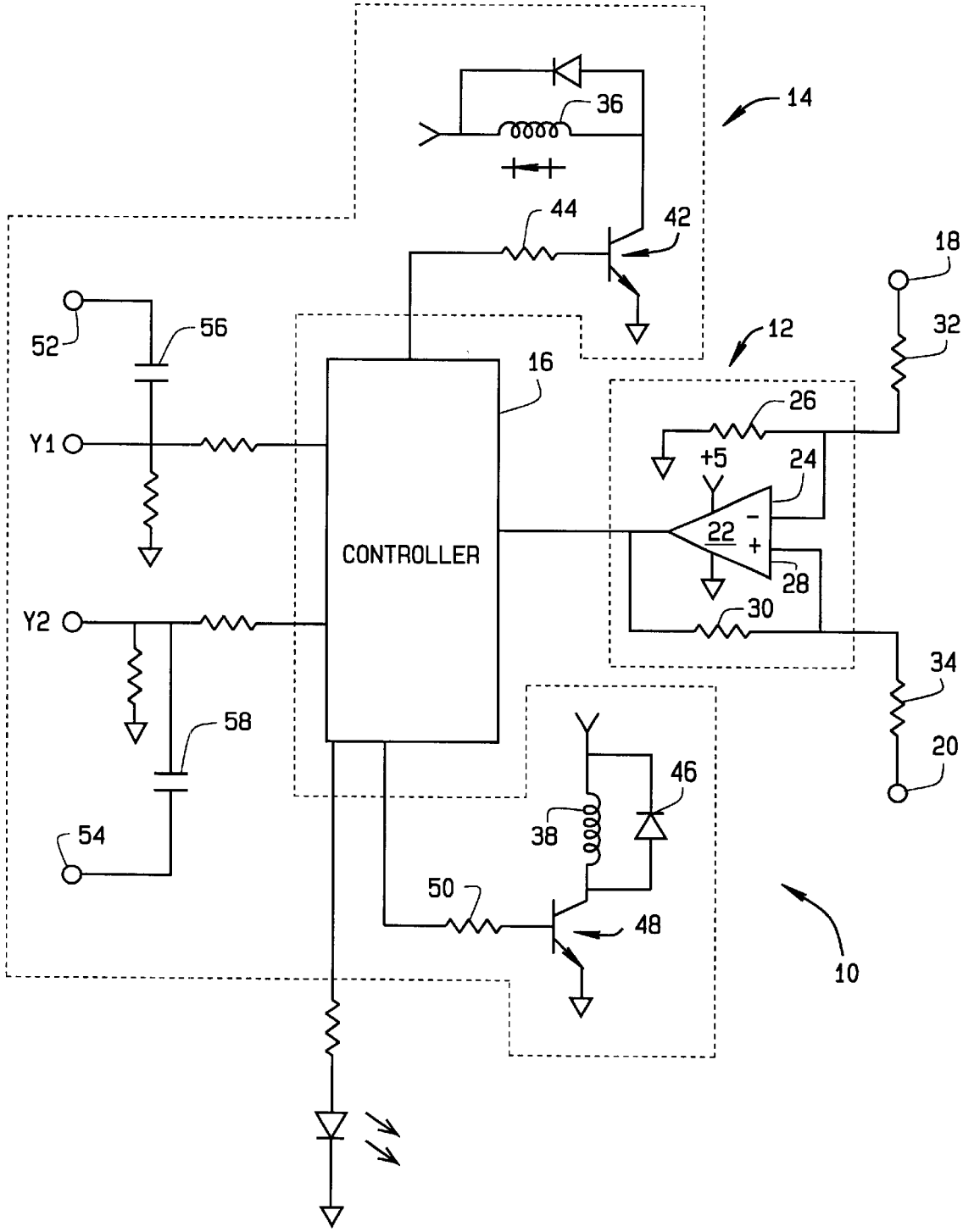
FIG. 1 displays a schematic of a compressor control system in accordance with the present invention.

Referring to FIG. 1, various components of an HVAC system are shown generally as 10. Such components include a line voltage measurement circuit 12, a compressor relay circuit 14, and a controller 16 in communication with the line voltage measurement circuit 12 and the compressor relay circuit 14. Line voltage, typically in the amount of 120 Volts, is applied to the system 10 via a first line voltage terminal 18 and a second line voltage terminal 20. The line voltage measurement circuit 12 includes an operational amplifier 22 and a pair of divider resistors. In particular, the operational amplifier 22 includes an inverting pin 24 connected to a first divider resistor 26, which is in turn connected to ground 21, and a non-inverting pin 28 connected to a second divider resistor 30, which is in turn connected to the output of the operational amplifier 22. The inverting pin 24 also connects to the first line voltage terminal 18 via a first line voltage resistor 32, while the non-inverting pin 28 connects to the second line voltage terminal 20 via a second line voltage resistor 34. The output signal of the line voltage measurement circuit 12 represents an attenuated version of the difference in voltage between the first line voltage terminal 18 and the second line voltage terminal 20, which is measured thereby which is then input to the controller 16.

The controller 16 includes an analog-to-digital (A/D) converter (not shown) which measures the positive peak of each cycle of the sine wave of the output signal received from the line voltage measurement circuit 12. The controller 16 further includes memory (not shown) for storing at least a first threshold voltage, preferably 80 percent of rated voltage against which the voltage difference measured by the line voltage measurement circuit 12 is compared. The controller 16 also preferably includes a counter (also not shown) which is initialized when the voltage difference is less than the first threshold voltage and is incremented until it reaches a predetermined number, which equates to the amount of time, preferably eight seconds, the voltage difference remains less than the first threshold voltage. Once the counter reaches a predetermined number, the compressor (not shown) is at risk of overheating. The memory of the controller 16 may also store a second threshold voltage representing a base voltage, preferably a value sufficiently below 80 percent rated voltage, over which the voltage difference must be maintained in order to prevent immediate risk of overheating of the compressor. It can be understood that the first and second threshold voltages may change depending on the line voltage applied to the system 10, and also the manufacturer's specifications for various compressors. The controller further includes a compressor control mechanism, preferably in the form of software, for controlling operation of the compressor based on the output of the compared voltages and the counter. In particular, once the voltage difference is less than the first threshold voltage for longer than the predetermined time or the voltage difference goes below the second threshold voltage, the compressor control mechanism switches the compressor off to prevent overheating. The controller preferably includes an indicator, such as a light emitting diode, for indicating when the compressor has been locked out. The controller 16 further includes a diagnostic output signal for transmission to ground via a third resistor 56 and third diode 53, to indicate why the compressor shut down.

The compressor relay circuit 14 includes a first compressor contractor relay coil 36 and a second compressor contractor relay coil 38. The first compressor contact relay coil 36 is connected in parallel with a first diode 40, and the combination is in turn connected to the controller 16 via a first transistor 42 and a first resistor 44. The second compressor contractor relay coil 38 is connected in parallel with a second diode 46, and the combination is in turn connected to the controller 16 via a second transistor 48 and a second resistor 50. The compressor relay circuit 14 further includes a first compressor contractor terminal 52 and a second compressor contractor terminal 54 connected to the controller 16 and output signals Y1. and Y2 From a thermostat (not shown) through a first compressor contact 56 and a second compressor contact 58, respectively. Once the first and second compressor contractor relay coils 36 and 38 are sufficiently energized, the first and second compressor contacts 56 and 58 close to permit the transmission of the Y1 and Y2 output signal of the thermostat to the first and second compressor contractor terminals 52 and 54. The terminals 52 and 54 lead to the compressor contractor coil (not shown), which when sufficiently energized switches line voltage to the compressor.

In a preferred embodiment, controller 16 is a MSC68HC705P6, first and second divider resistors 26 and 30 are 24 kOhm resistors, first and second line voltage resistors 32 and 34 are 1 Mohm resistors, first and second contractor relay coils 36 and 38 are SPAT relay coils, first and second diodes 40 and 46 are IN4004 diodes, first and second resistors 44 and 50 are 10 kOhm resistors, and first and second transistors 42 and 48 are 2N3904 transistors.

Figure 2:
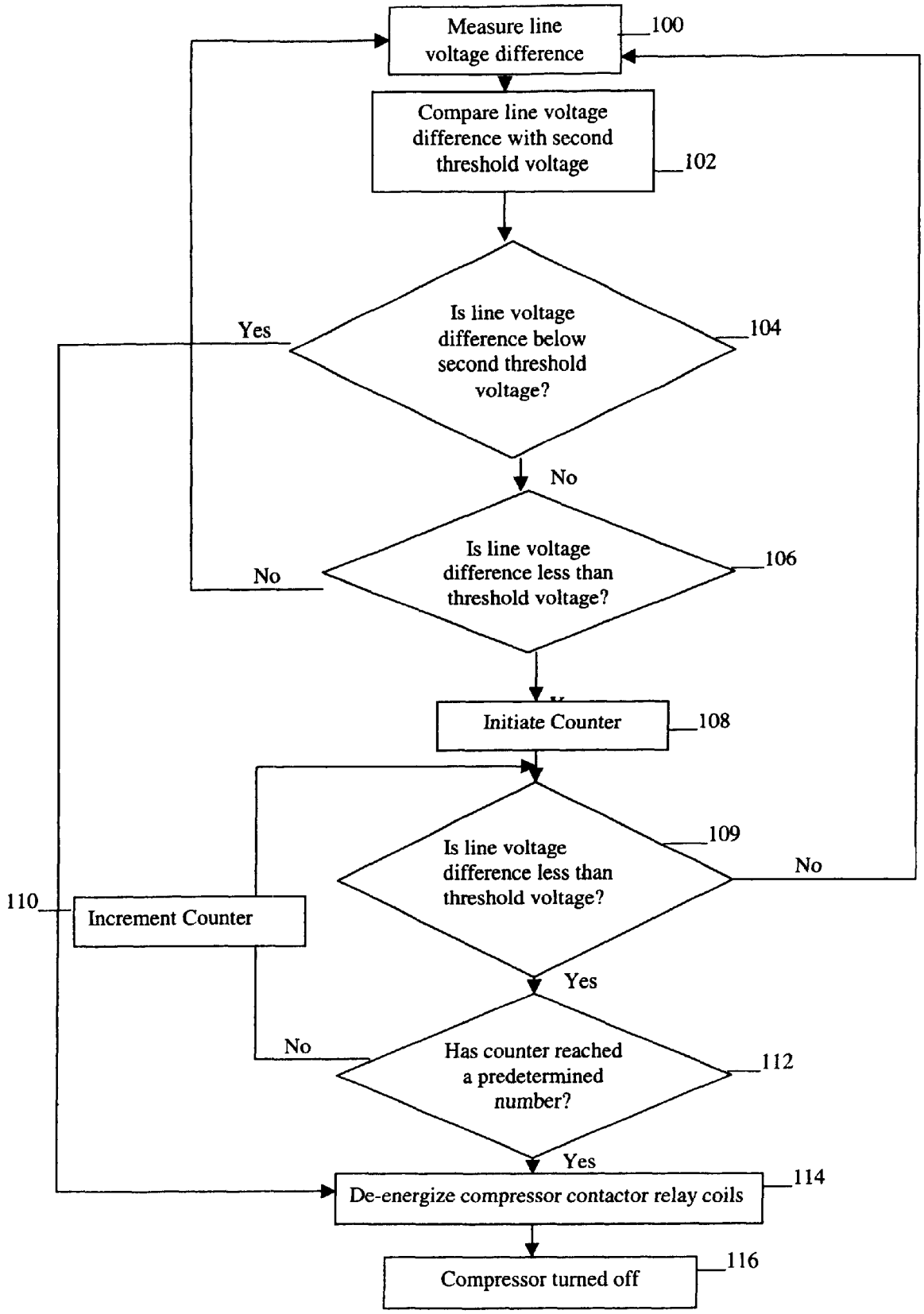
FIG. 2 displays a flow chart outlining a method of controlling the compressor of FIG. 1 in accordance with the present invention.

The system 10 of FIG. 1 will now be described in operation with respect to FIG. 2. At 100, the line voltage measurement circuit 12 measures the difference in line voltage between the first line voltage terminal 18 and the second line voltage terminal 20. At 102, the controller 16 compares the line voltage difference measured by the line voltage measurement circuit 12 with the second threshold voltage stored within the memory of the controller 16. At 104, the controller 16 checks whether the line voltage difference is below the second threshold voltage. If so, at 114, the controller 16 sends a signal to the compressor contractor relay coils 36 and 38 to de-energize. If not, at 106, the controller 16 checks whether the line voltage difference is less than the first threshold voltage. If not, the line voltage measurement circuit 12 takes another measurement of the difference in the line voltage between the first line voltage terminal 18 and the second line voltage terminal 20 at 100, and at 102, the controller 16 makes another comparison. If so, at 108 the controller 16 initiates the counter and at 109, another check is made whether the line voltage difference is less than the threshold voltage. If not, steps 100 through 108 are repeated. If so, at 110, the controller 16 checks whether the counter has reached a predetermined number. If not, at 112, the counter is incremented. If so at 114, the controller 16 sends a signal to the compressor contractor relay coils 36 and 38 to de-energize, and at 116, the compressor is locked out.

The foregoing constitutes a description of various features of a preferred embodiment. Numerous changes to the preferred embodiment are possible without departing from the spirit and scope of the invention. Hence, the scope of the invention should be determined with reference not to the preferred embodiment, but to the following claims:

I claim:

1. A control system for controlling operation of a compressor in a device powered by a line voltage between first and second line voltage terminals, comprising:

a line voltage measurement circuit for measuring a difference in voltage between the first line voltage terminal and the second line voltage terminal before and during the energizing of the compressor; and a controller in communication with the line voltage measurement circuit and the compressor, the controller comprising a comparator having an output for comparing the voltage difference to at least one reference threshold voltage, and compressor control means for controlling operation of the compressor based on the output of the comparator.

2. The control system of claim 1, wherein the compressor control means comprises switching means for switching the compressor off when the voltage difference is less than the at least one reference threshold voltage.

3. The control system of claim 1, wherein the controller further comprises means for storing the at least one reference threshold voltage.

4. The control system of claim 1, wherein the compressor control means comprises a switching means, and the controller comprises a counter initialized when the voltage difference is less than one of the at least one threshold voltages and updated for as long as the output of the comparator shows the voltage difference less than the one of the at least one threshold voltages, and wherein the compressor is switched off by the switching means when the counter indicates that a predetermined period of time has expired.

5. The control system of claim 1, wherein the line voltage measurement circuit comprises an operational amplifier having an inverting input pin connected to a first divider resistor, and a non-inverting input pin connected to a second divider resistor.

6. The control system of claim 2, wherein the controller further comprises indicator means for indicating when the compressor is turned off.

7. The control system of claim 3, wherein the controller further comprises indicator means for indicating when the compressor is turned off.

8. The control system of claim 1, wherein the controller is a microcomputer.

9. A method for controlling operation of a compressor in a device powered by a line voltage between first and second line voltage terminals and having a controller, comprising:

measuring a difference in voltage between the first line voltage terminal and the second line voltage terminal before and during the energizing of the compressor;

storing at least a first threshold voltage in the controller;

comparing a peak of the voltage difference to the first threshold voltage;

and controlling operation of the compressor based on the comparison between the voltage difference and the first threshold voltage.

10. The method of claim 9, further comprising:

counting the period of time during which the voltage difference is less than the first threshold voltage; and switching the compressor off when the period of time exceeds a predetermined period of time.

11. The method of claim 9, further comprising:

storing a second threshold voltage in the controller; and switching the compressor off when the voltage difference goes below the second threshold voltage.

12. The method of claim 10, further comprising indicating to an operator of the device when the compressor is turned off.

13. A method for controlling operation of a compressor in a device powered by a line voltage between first and second line voltage terminals and having a controller, comprising:

measuring a difference in voltage between the first line voltage terminal and the second line voltage terminal before and during the energizing of the compressor;

storing a threshold voltage in the controller; and controlling operation of the compressor based on a comparison between a peak of the voltage difference and the threshold voltage.

14. The method of claim 13, further comprising switching the compressor off when the voltage difference goes below the threshold voltage.

15. The method of claim 14, further comprising indicating to an operator of the device when the compressor is turned off.

16. An HVAC system powered by a line voltage between two line voltage terminals and having a compressor, the system comprising:

a line voltage measurement circuit configured to produce a difference signal representing a voltage difference between the terminals;

a controller configured to perform a comparison of a peak of the difference signal to a reference threshold voltage; and a compressor relay circuit configured to operate the compressor based on the comparison.

17. The HVAC system of claim 16 wherein the line voltage measurement circuit comprises:

an operational amplifier having an inverting pin and a non-inverting pin;

a first divider resistor connected between the inverting pin and a ground;

a second divider resistor connected between the non-inverting pin and the difference signal; and a pair of line voltage resistors connected between the pins and the terminals.

18. The HVAC system of claim 16 wherein the controller comprises an analog-to-digital converter configured to measure a positive peak of the difference signal.

19. The HVAC system of claim 16 wherein the controller is further configured to de-energize the compressor relay circuit based on the comparison.

20. The HVAC system of claim 16 wherein the reference threshold voltage comprises a predetermined percentage of a rated voltage, the controller further configured to switch the compressor off when the peak of the difference signal is less than the predetermined percentage of the rated voltage.

21. The HVAC system of claim 16 wherein the reference threshold voltage comprises a predetermined percentage of a rated voltage, the controller further configured to switch the compressor off when the peak of the difference signal is less than the predetermined percentage of the rated voltage during a predetermined time period.

22. A method for controlling operation of an HVAC system powered by a line voltage between first and second line voltage terminals and having a compressor, comprising:

outputting a signal representing a difference in voltage between the first line voltage terminal and the second line voltage terminal;

comparing a peak of the output signal to a reference voltage; and conditioning operation of the compressor on a result of the comparing.

23. The method of claim 22 wherein the HVAC system includes a controller, the method further comprising storing the reference voltage in a memory of the controller.

24. The method of claim 22 Wherein the reference voltage comprises a predetermined percentage of a rated voltage, the method further comprising switching off the compressor when the output signal peak is less than the predetermined percentage of the rated voltage.

25. The method of claim 24 further comprising issuing a diagnostic signal when the compressor is switched off.

26. The method of claim 22 further comprising de-energizing a compressor relay circuit based on the result of the comparing.

27. The control system of claim 1, wherein the compressor control means comprises a switching means, and the controller comprises a counter initialized when the voltage difference is less than one of the at least one threshold voltages and updated while the output of the comparator shows the voltage difference less than the one of the at least one threshold voltages, and wherein the compressor is switched off by the switching means when the counter reaches a predetermined count.

* * * * *